US005219196A

United States Patent [19]

Luker

[11] Patent Number: 5,219,196

[45] Date of Patent: Jun. 15, 1993

[54] LOCKS

[76] Inventor: Graham J. Luker, 658 Port Hacking Road, Lilli Pilli, New South Wales, Australia, 2229

[21] Appl. No.: 790,738

[22] Filed: Nov. 8, 1991

[30] Foreign Application Priority Data

Nov. 9, 1990 [AU] Australia ..... PK3265

[51] Int. Cl.[5] ..... E05B 47/00

[52] U.S. Cl. ..... 292/341.16; 70/283; 292/207

[58] Field of Search ..... 292/341.16, 341.17, 292/DIG. 60, 20, 207, 252; 70/283

[56] References Cited

U.S. PATENT DOCUMENTS 2,767,011 10/1956 Buckley ..... 292/341.16
3,543,547 12/1970 Sugiyama ..... 292/341.16 X
4,015,869 4/1977 Horvath ..... 292/341.16
4,056,277 11/1977 Gamus et al. ..... 292/341.16
4,616,865 10/1986 Mackle ..... 292/341.16
4,867,496 9/1989 Thomas ..... 292/341.16
4,995,248 2/1991 Liu ..... 70/283

*Primary Examiner*—Richard E. Moore

[57] ABSTRACT

A strike mechanism for a door lock comprising a recessed strike plate (9) which in use is fitted into a door jamb to receive a latch bolt (14) and a strike (10) which is pivotal between a first position in which the bolt (14) is held within the recess and the door is locked shut and a second position in which the bolt (14) is released so the door may be opened. The strike (10) is lockable in the first position by pins (19, 20, 21) which are remotely operable by a solenoid (26) to extend or retract across adjoining surfaces of the strike (10) and plate (9) and prevent relative movement therebetween.

7 Claims, 4 Drawing Sheets

LOCKS

FIELD OF THE INVENTION

This invention relates to locks and more particularly to remotely operated strikes for door latches.

BACKGROUND OF THE INVENTION

Door locks having remotely operated strikes are often used in security installations such as blocks of home units, hospitals, banks, commercial building and private dwellings. The doors are fitted with a retractable spring loaded latch bolt which upon closing rides over the edge of a strike plate and into a recess in said plate. The strike itself however is remotely operable between a locked mode in which the bolt is held within the plate recess and an unlocked mode in which the bolt is able to be pulled from the recess without retracting it. This arrangement allows the door to be self closing while at the same time it is still able to be locked or unlocked by remote activation of the strike.

An example of a conventional strike plate is shown in cross section by FIG. 1. The strike 1 is pivotal around a pin 2 between a locking position 3 and an unlocked position 4 so that the bolt 5 can be either held within recess 6 or released in the direction of arrow 8 to open the door. The actual movement of the strike is obtained through a system of levers and solenoid (not shown). There are however a number of disadvantages with these existing systems. For example a degree of sliding friction between the inside surface 7 of the strike and bolt must be overcome when releasing the lock and this can inhibit its operation. A relatively bulky (and in some instances easily accessible via joints) lever system is also required to withdraw and/or retain the security of the strike which retains the latch bolt tongue. This makes the mechanism easier to pick. The offset location of the pivot to one side of the recess also increases its size. Further, the existing lever system must be specially constructed for either fail safe or fail secure operation of the door lock and cannot be readily changed by the user.

SUMMARY OF THE INVENTION

It is therefore an object of this invention to ameliorate the aforementioned disadvantages and accordingly a strike mechanism for a door lock is disclosed comprising a recessed strike plate which in use may be fitted into a door jamb to receive a latch bolt and a strike pivotal in said plate between a first position in which said bolt is held within the recess and a second position in which said bolt is released, wherein said strike is lockable in said first position by pin means remotely operable to extend across adjoining surfaces of said strike and plate and prevent relative movement thereof.

BRIEF DESCRIPTION OF THE DRAWINGS

The currently preferred form of this invention will now be described with reference to the attached drawings in which.

DETAILED DESCRIPTION OF THE EMBODIMENTS

Figure 6:
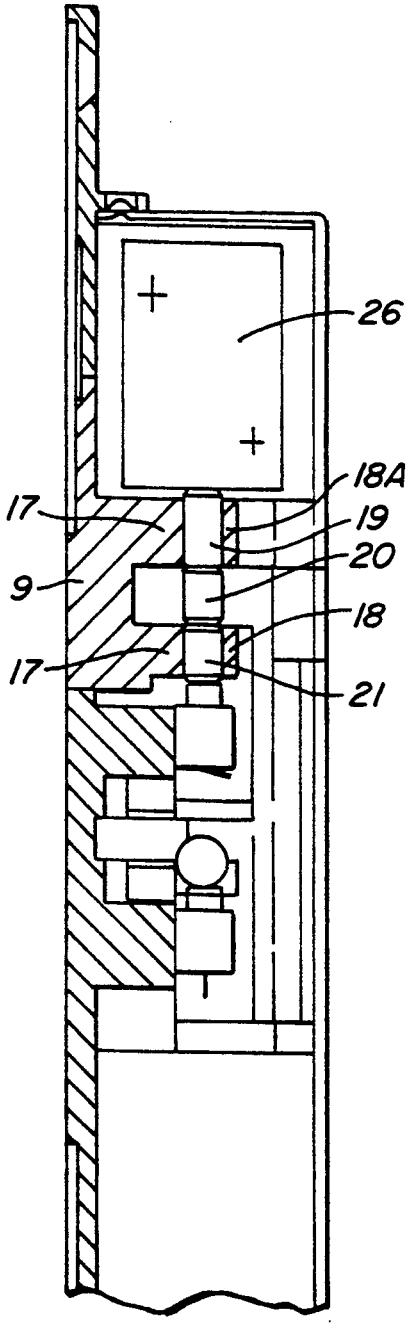
FIG. 6 is a cross-sectional view along the lines B—B of FIG. 5, FIGS. 7 and 7A are detailed views of the pawl.
Figure 5:
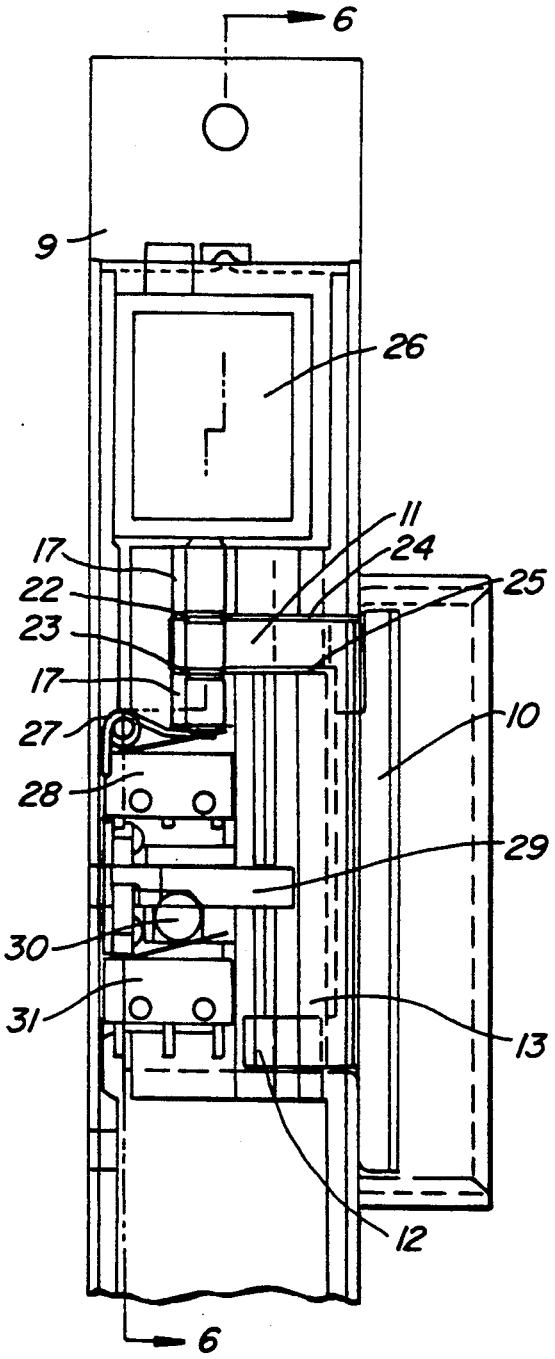
FIG. 5 is a front view of the strike.

Referring first to FIGS. 2 to 6 there is shown a recessed strike plate 9 for insertion into a mortised door jamb or the like. The strike 10 is formed with upper and lower hinge arms 11 and 12 which rotate about pivot 13 in the plate so that it can shift between the retracted position shown in FIG. 3 where a latch bolt 14 is retained within recess 15 (so the door is held shut) and the extended position of FIG. 4 where the bolt is released. In accordance with this invention the upper hinge arm 11 of the strike is enlarged and includes an aperture 16 which upon movement of the strike passes between plate flanges 17. These flanges also have co-axial apertures 18, 18A and when the strike is in the retracted position shown by FIG. 3 the apertures 16, 18, and 18A are all aligned. A set of three hardened steel pins 19, 20 and 21 are fitted within these apertures as indicated in FIGS. 5 and 6. When the positions of the abutting end faces 22 and 23 of these pins correspond with the gaps 24 and 25 between hinge arm 11 and adjacent flanges as shown the strike is free to rotate to the release position of FIG. 4. Displacement of the pins downward however locks the mechanism as the solid sections of the pins 19 and 20 then extend across these gaps. In this position a locking action on the strike is obtained which is much stronger than with prior art levered systems. The latch bolt is thus securely held within a recess 15 so that the door cannot be opened. A spring is also used to preload the strike 10 into a close position against a stop. This eliminates any loading against the pins. Preferably these pins are displaced by means of a remotely operable solenoid 26 against a spring 27 so that upon cessation of power the pins are pushed back up to their original position where the strike is again free to rotate. A microswitch 28 may also be located under the pins to provide an indication of their position.

It is to be noted that the novel placement of the pivot 13 for the strike which enables it to rotate out of the jamb as the bolt is released eliminates problems with friction, reduces wear on the strike and allows a more compact housing for the mechanism. Also the small amount of pin travel required to lock/unlock the strike relative to lever systems enables a smaller solenoid to be used with further reductions in size.

With the embodiment shown the pins are arranged to provide a fail safe operation so that in the absence of power to the solenoid the strike is free to rotate and the door to open. If however fail secure operation is required to ensure that the door remains locked in the absence of power this can be achieved simply by rearranging the pins so that the long pin 19 is furthest from the solenoid. In this configuration the strike is released only so long as the solenoid is energized. Thus either type of operation can be obtained by the user without special equipment or replacement parts being required.

Figure 7:
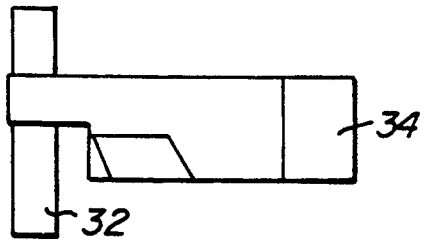
Figure 7A:
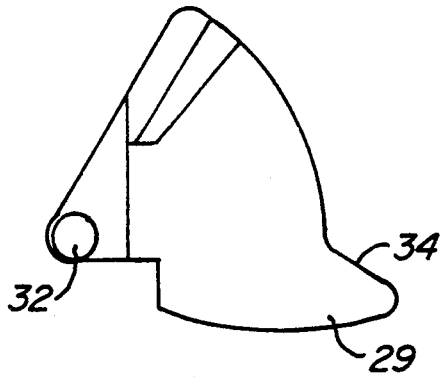

Preferably a spring loaded pawl 29 is also located within recess 15. This is depressed when the bolt enters the recess and through displacement of a ball 30 trips a second microswitch 31 to indicate when the door is closed. The pawl is so configured that the pivot point 32 (see FIG. 7) is located at a point 33 as close as possible to the top surface of the strike 10. This enables a natural rotation with the latch tongue while displacing the microswitch. Because of this configuration the pawl size can be smaller. By contrast prior art mechanisms work via long levers or by straight displacement rather than rotational movement. As shown in FIG. 7 the pawl is also shaped so that it lays flush in recess 15. This restricts access to within the body of the strike, prevents direct overload of the microswitch and restricts movement of the pawl to a position flush with surface 33A. In other words surface 34 of the pawl is stopped by surface 35.

Figure 1:
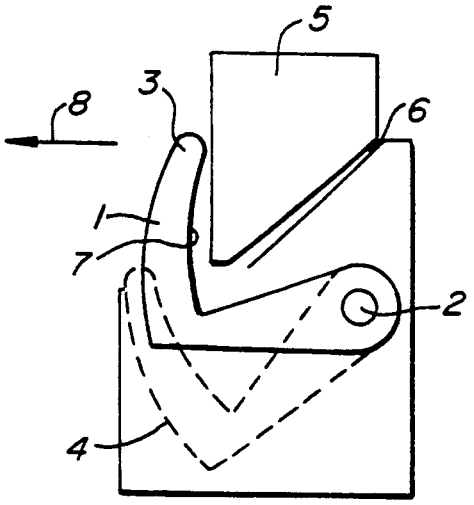
FIG. 1 is a prior art strike plate.
Figure 2:
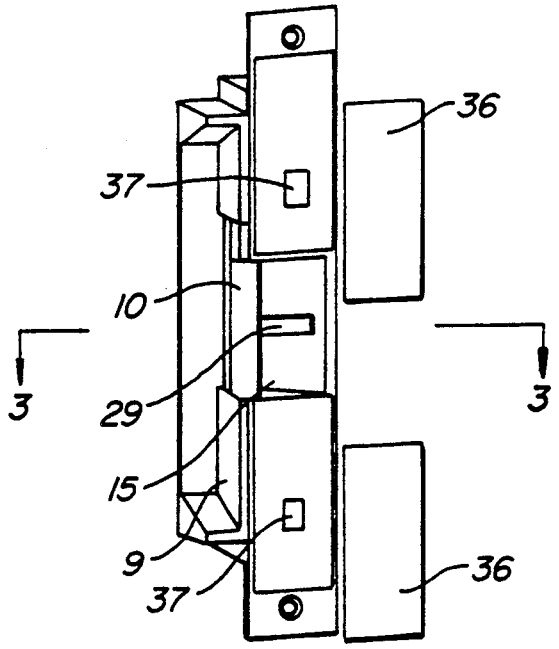
FIG. 2 is a perspective view of a first embodiment of a strike according to this concept.
Figure 3:
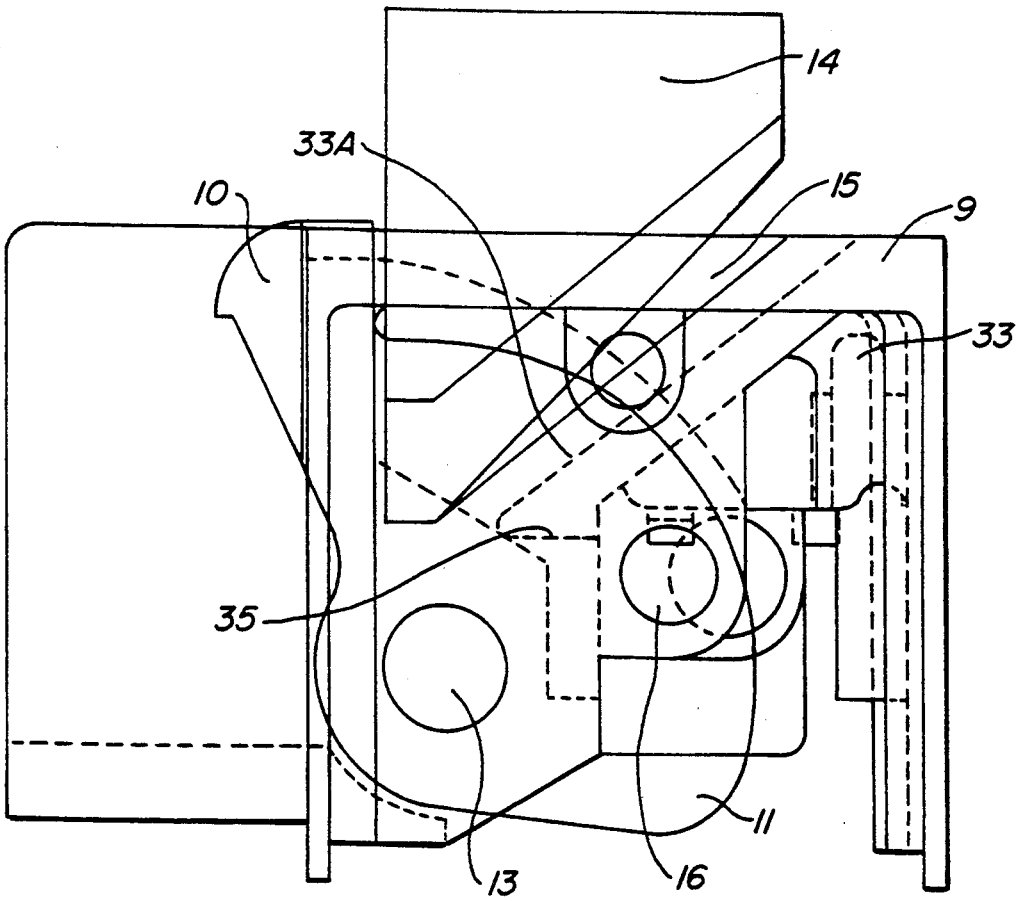
FIGS. 3 and 4 are cross-sectional views along the lines A—A of FIG. 2.
Figure 4:
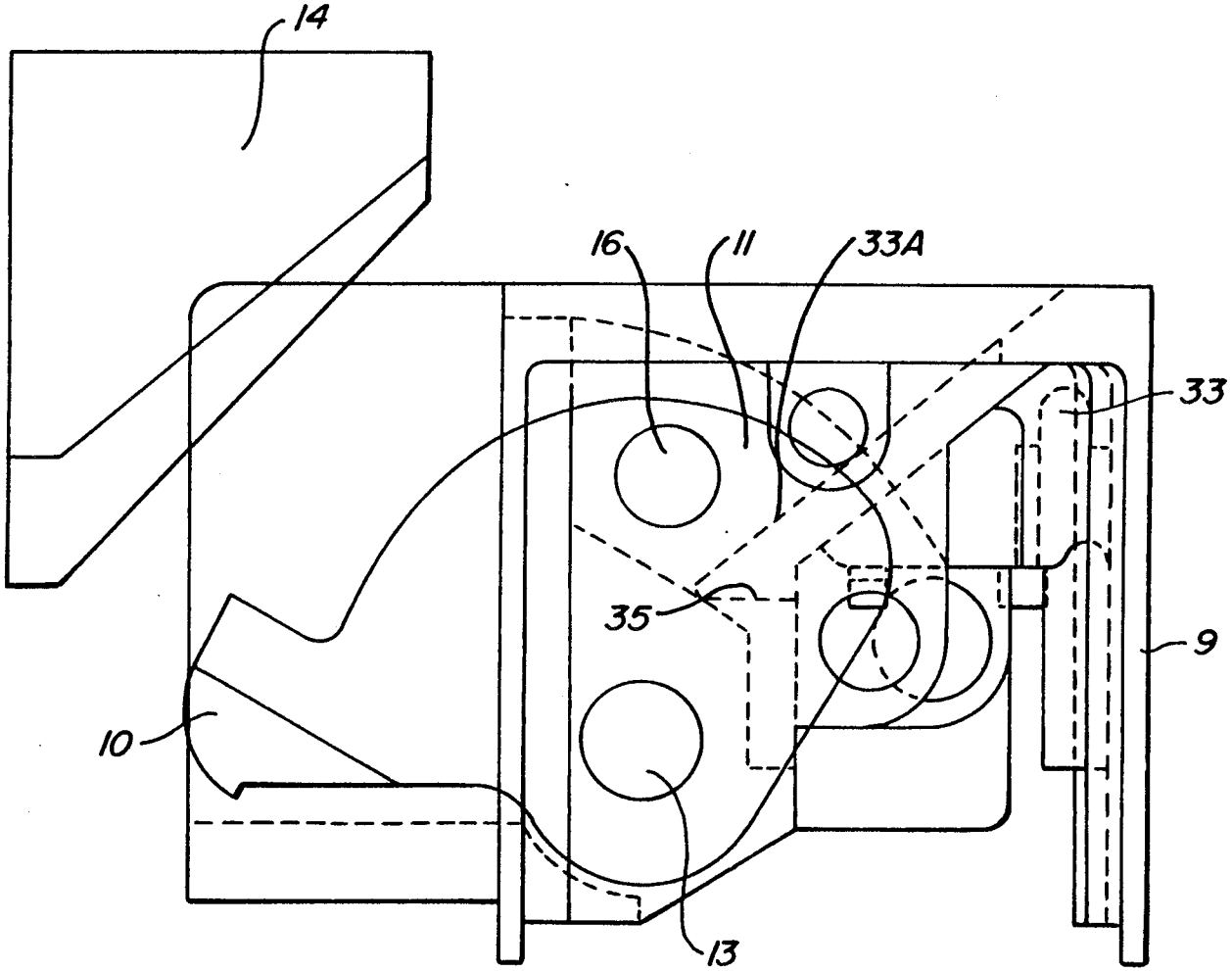

As a further preferred feature this invention also discloses the use of inserts 36 for the outside face of the strike plate as shown in FIG. 2. These provide a high quality appearance for the lock at a much lower cost than present manufacturing methods which produce a finished surface over the whole front of the plate. These inserts would also serve to conceal the mounting screws for the plate and insure that the manufacturer's name or trademark appearing thereon is presented right side up irrespective of the orientation of the plate. Preferably the inserts would be held in place by adhesive or strips of double sided adhesive tape 37.

Figure 8:
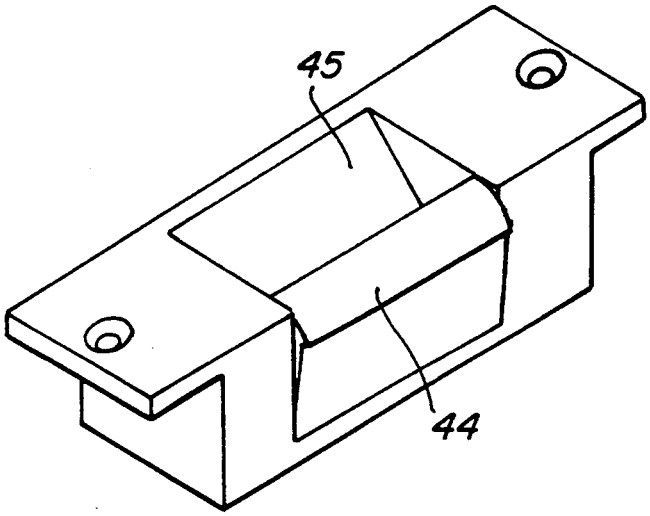
FIG. 8 is a perspective view of a second embodiment of a strike according to this invention.
Figure 9:
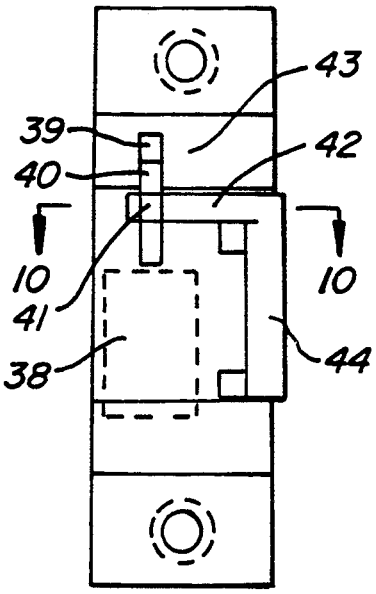
FIG. 9 is a front view of the strike of FIG. 8.
Figure 10:
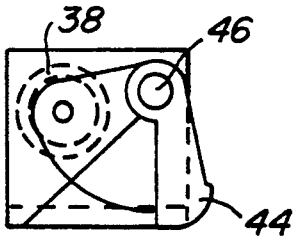
FIG. 10 is a cross-sectional view along the lines C—C of FIG. 9.

Using the multi-pin system of this invention in the arrangement shown in the second embodiment of FIGS. 8 to 10 it is possible to reduce the size of the strike mechanism still further. In this case the spring loaded pawl and associated microswitch are eliminated and a solenoid 38 inserted in their place. This solenoid displaces pins 39, 40 and 41 through apertures in the striker hinge arm 42 and plate flange 43 in a manner similar to that of the first embodiment to either lock the striker 44 within recess 45 or release it to rotate about pivot 46 out of the recess.

It will thus be appreciated that this invention at least in the form of the embodiments disclosed provides a novel and unique improvement in remotely operated strikes for door locks. Clearly however the examples described are only the currently preferred forms of this invention and a wide variety of modifications may be made which would be apparent to a person skilled in the art. For example, the shape and configuration of the striker and strike plate as well as the shape and number of locking pins may all be changed according to application or design preference. Also while the stress carrying parts of the mechanism are preferably constructed from hardened steel the invention extends to the use of any other suitable material.

What is claimed is:

1. A strike plate for a door lock comprising a recessed plate means which in use may be fitted into a door jamb to receive a latch bolt and a strike pivotal in said plate means between a latch bolt retention position and a latch bolt non-retention position and a plurality of axially aligned pins axially movable in a direction so that one of said pins extends through respective aligned apertures in adjoining surfaces of said strike and plate means to secure said strike in said latch bolt retention position and said strike being releasable to pivot to said latch bolt non-retention position by axially moving said pins in another opposite direction so that the end position of one or more of said pins corresponds with said adjoining surfaces and said plurality of pins being of at least two different lengths and being able to be arranged in different sequences to provide either fail safe or fail secure operation of the door lock.

2. The strike plate as claimed in claim 1 wherein said plurality of pins are axially movable by a solenoid against a spring bias.

3. The strike plate as claimed in claim 2 wherein the strike is biased to said latch bolt retention position.

4. The strike plate as claimed in claim 1 wherein the pivot for the strike is located in said plate means at a location whereby said strike pivots to said latch bolt non-retention position without any significant sliding friction against said latch bolt.

5. The strike plate as claimed in claim 4 wherein a first microswitch is provided within said plate means which is adapted to indicate the position of said plurality of pins.

6. The strike plate as claimed in claim 5 wherein a spring loaded pawl is located within the recess of said plate means, said pawl being depressed against a spring to trip a second microswitch when said latch bolt is in said recess.

7. The strike plate as claimed in claim 6 wherein the pawl is shaped to lay flush with the inside surface of the recess when said pawl is depressed.

* * * * *